US007319766B2

(12) United States Patent
Hall et al.

(10) Patent No.: US 7,319,766 B2
(45) Date of Patent: Jan. 15, 2008

(54) IN-WALL LOUDSPEAKER

(75) Inventors: David S. Hall, Los Altos Hill, CA (US); Chris Kallai, San Jose, CA (US); Richard Yoder, Fresno, CA (US); Felix E. Stephens, Los Banos, CA (US)

(73) Assignee: Velodyne Acoustics, Inc., Morgan Hill, CA (US)

( * ) Notice: Subject to any disclaimer, the term of this patent is extended or adjusted under 35 U.S.C. 154(b) by 0 days.

(21) Appl. No.: 11/549,498

(22) Filed: Oct. 13, 2006

(65) Prior Publication Data

US 2007/0116304 A1 May 24, 2007

Related U.S. Application Data

(60) Provisional application No. 60/726,439, filed on Oct. 13, 2005.

(51) Int. Cl.
*H04R 1/02* (2006.01)

(52) U.S. Cl. ..... 381/152; 381/386; 381/417; 381/423; 381/335

(58) Field of Classification Search ..... 381/87, 381/334, 335, 332, 395, 431, 417, 386, 152, 381/418, 423; 181/160–162
See application file for complete search history.

(56) References Cited

U.S. PATENT DOCUMENTS

| | | | | |
|---|---|---|---|---|
| 5,082,084 | A * | 1/1992 | Ye-Ming | 181/153 |
| 5,740,264 | A * | 4/1998 | Kojima | 381/423 |
| 6,609,589 | B2 * | 8/2003 | Combest | 181/150 |
| 6,611,604 | B1 * | 8/2003 | Irby et al. | 381/398 |
| 2005/0008188 | A1 * | 1/2005 | Harris | 381/404 |
| 2005/0072624 | A1 | 4/2005 | Ryu et al. | |

* cited by examiner

*Primary Examiner*—Sinh Tran
*Assistant Examiner*—Walter F Briney, III
(74) *Attorney, Agent, or Firm*—Black Lowe & Graham, PLLC

(57) ABSTRACT

An improved in-wall speaker assembly providing better performance and less intrusion than prior art speakers. The speaker assembly is oriented such that the driver fires vertically, parallel to the wall studs, rather than horizontally and perpendicular to the wall studs. The cone and surround of the speaker assembly are generally rectangular and/or conform to the area available between studs. Additionally, the cone is not attached to the voice coil, but is connected to the voice coil by a shaft which transmits the energy from the voice coil to the cone. In another aspect of the invention, the cabinet or housing includes two housings.

18 Claims, 13 Drawing Sheets

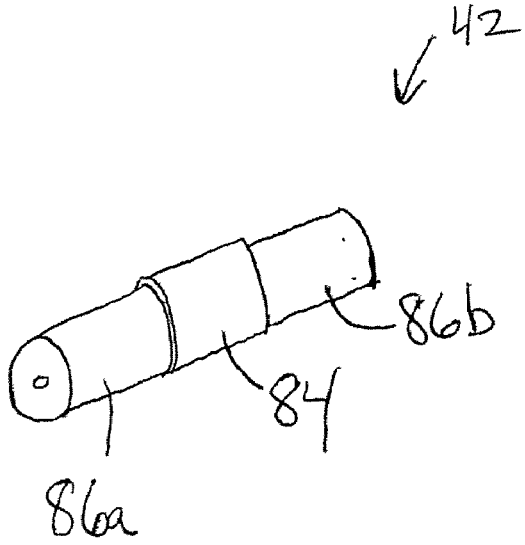
FIG. 6A
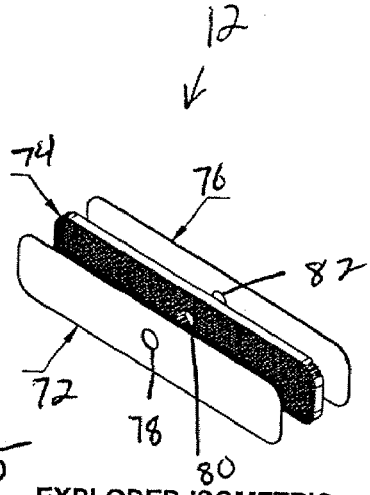
FIG. 5 EXPLODED ISOMETRIC (CROSS-SECTION AA)

IN-WALL LOUDSPEAKER

PRIORITY CLAIM

The present application claims priority to U.S. Provisional App. No. 60/726,439 filed Oct. 13, 2005 to Hall et al. titled "In-Wall Loudspeaker," and hereby incorporated by reference.

FIELD OF THE INVENTION

This invention relates generally to speakers and, more specifically, to in-wall mounted speaker systems.

BACKGROUND OF THE INVENTION

There is a growing demand for custom installed in-wall speakers with maximum performance and minimal intrusion to the interior of the home. One limitation on the configuration of in-wall speakers is the limited volume; in most situations, walls have 16" center, 3.5" depth wall studding. This limitation forces speakers with circular drivers with a diameter of 3.5" or larger to fire perpendicular to the plane of the wall. Speakers installed in this orientation cause undesirable vibration in the wall and are limited to a shallow cabinet with a restricted depth, limiting driver throw.

SUMMARY OF THE INVENTION

One form of the invention provided is an improved in-wall speaker assembly providing better performance and less intrusion than prior art speakers. The speaker assembly is oriented such that the driver reciprocates vertically, parallel to the wall studs, rather than horizontally and perpendicular to the wall studs. This orientation allows a greater speaker throw and larger cabinet area, reduces vibration in the wall, and reduces the size of the opening and grille in the wall to minimize intrusion.

The cone and surround of the speaker assembly are generally rectangular and/or conform to the area available between studs, in order to take maximum advantage of the space restriction caused by the configuration of the studs and drywall.

Additionally, in some forms of the invention the cone is not attached to the voice coil, but is connected to the voice coil via a shaft which transmits the energy from the voice coil to the cone. Prior art speakers have the voice coil attached to the cone and the spider attached to the voice coil. With the cone attached to the surround, the combination of the surround and the spider(s) create the speaker suspension system that both suspends the voice coil/cone assembly and provides linear travel through the magnetic gap between the motor housing and the magnets. This arrangement is a severe limitation when limited to the 3.5" width available to in-wall speakers. In this example, the voice coil and cone are separated by a shaft which transmits energy from the voice coil to the cone. The shaft and voice coil are kept centered in the gap by spiders located on the shaft, which allows for a larger spider assembly with a larger ratio of inner to outer diameter to be used, while still meeting the 3.5" width limitation.

In other examples of the invention, the cabinet or housing includes two housings. The first housing is mounted to the studs before drywall installation. The second housing containing the driver is mounted after drywall installation. In this way, expensive components are not installed until the house is securable against theft. Therefore, a smaller opening in the drywall is required to install the driver housing.

As will be readily appreciated from the foregoing summary, the invention provides an improved speaker assembly for in-wall speaker applications.

BRIEF DESCRIPTION OF THE DRAWINGS

Preferred and alternative embodiments of the present invention are described in detail below with reference to the following drawings:

FIG. 5 is an exploded isometric view of a cone of the speaker assembly of FIG. 3;

FIG. 6A is an isometric view of a shaft of the speaker assembly of FIG. 3.

DETAILED DESCRIPTION OF THE PREFERRED EMBODIMENT

Figure 1A:
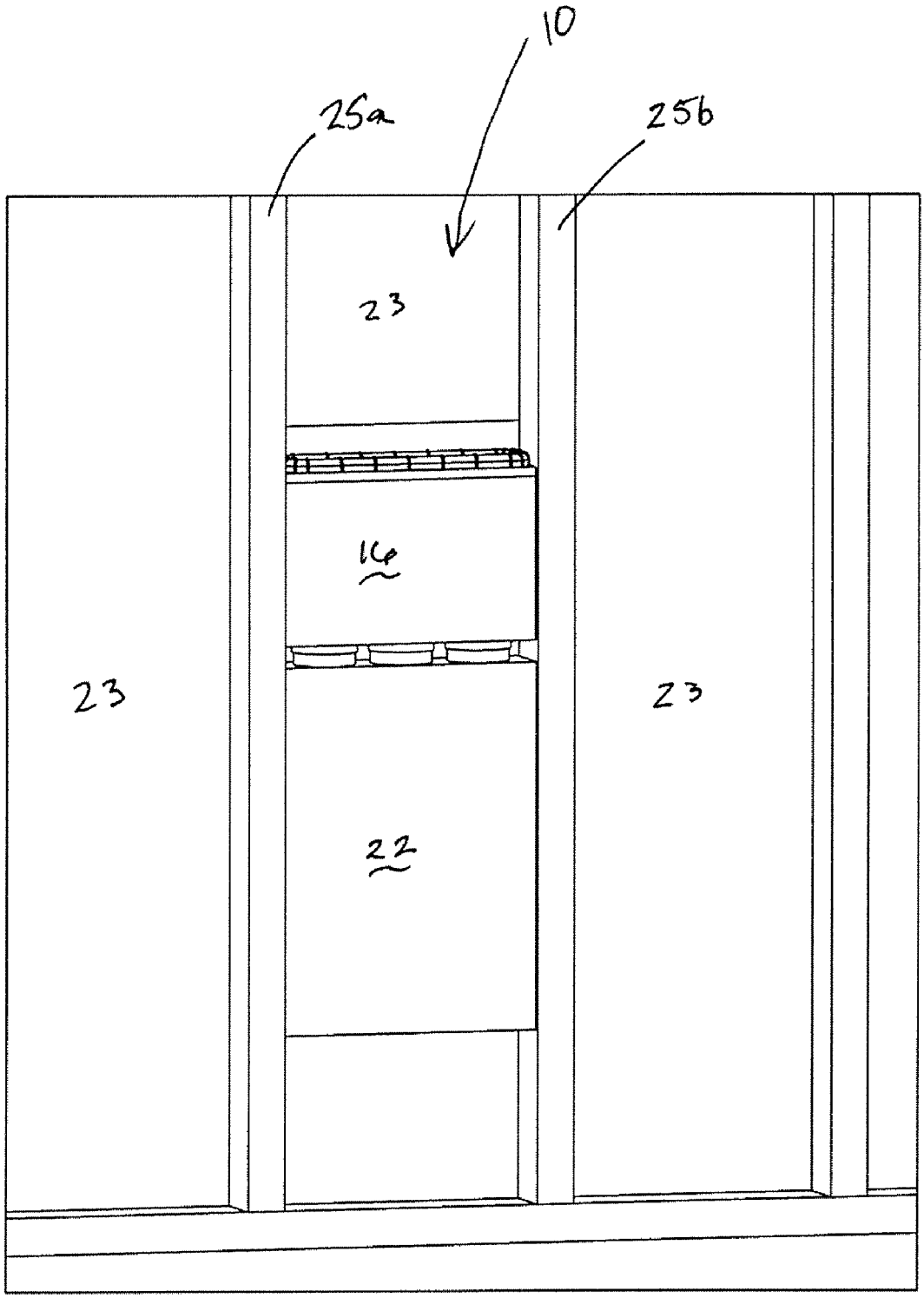
FIG. 1A-E are various views of a speaker system formed in according with the present invention.
Figure 1B:
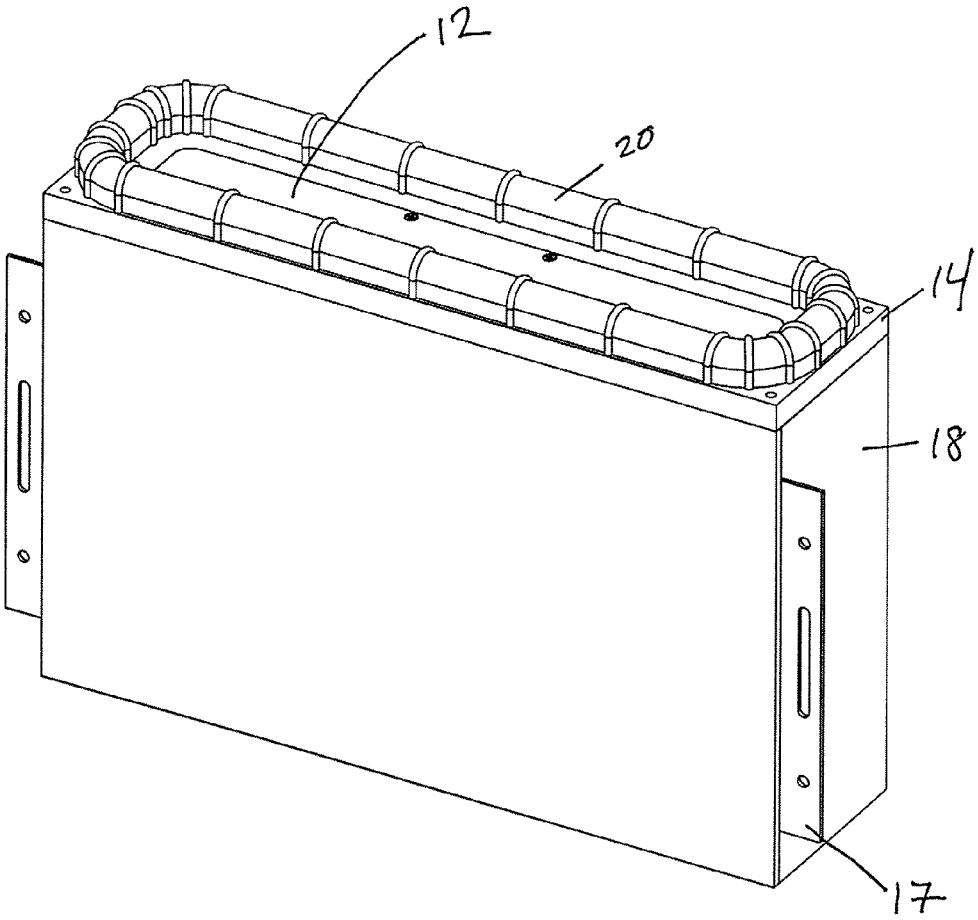
Figure 1C:
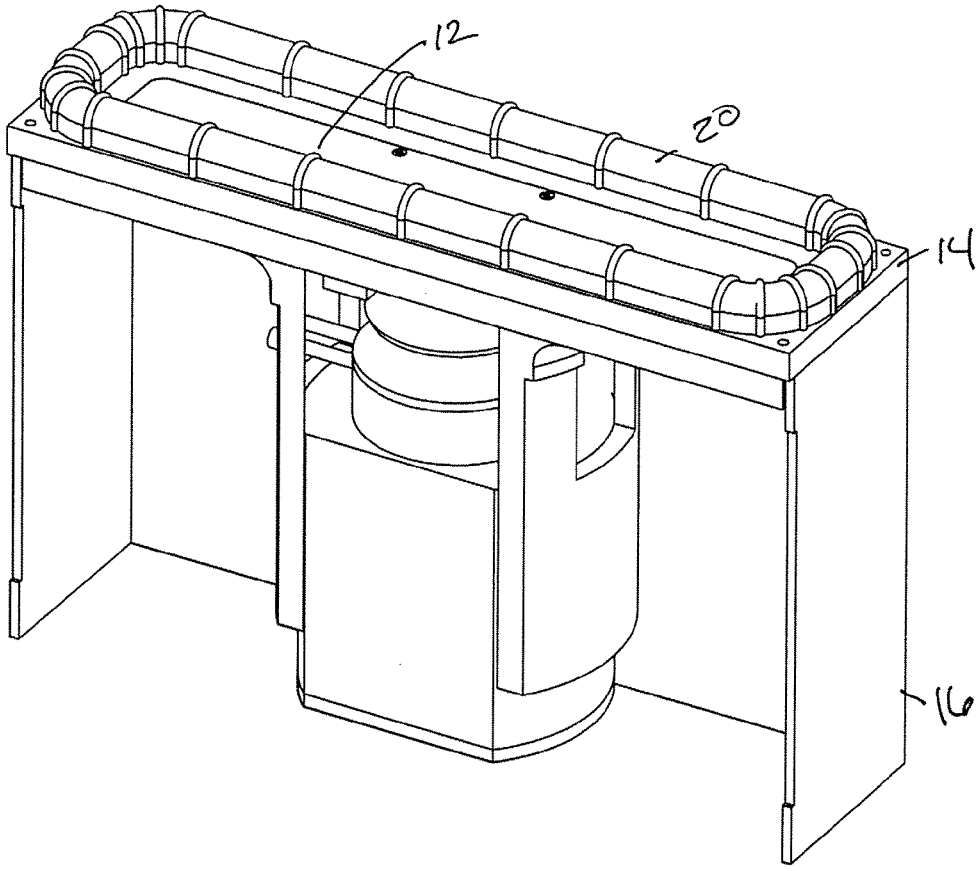
Figure 1D:
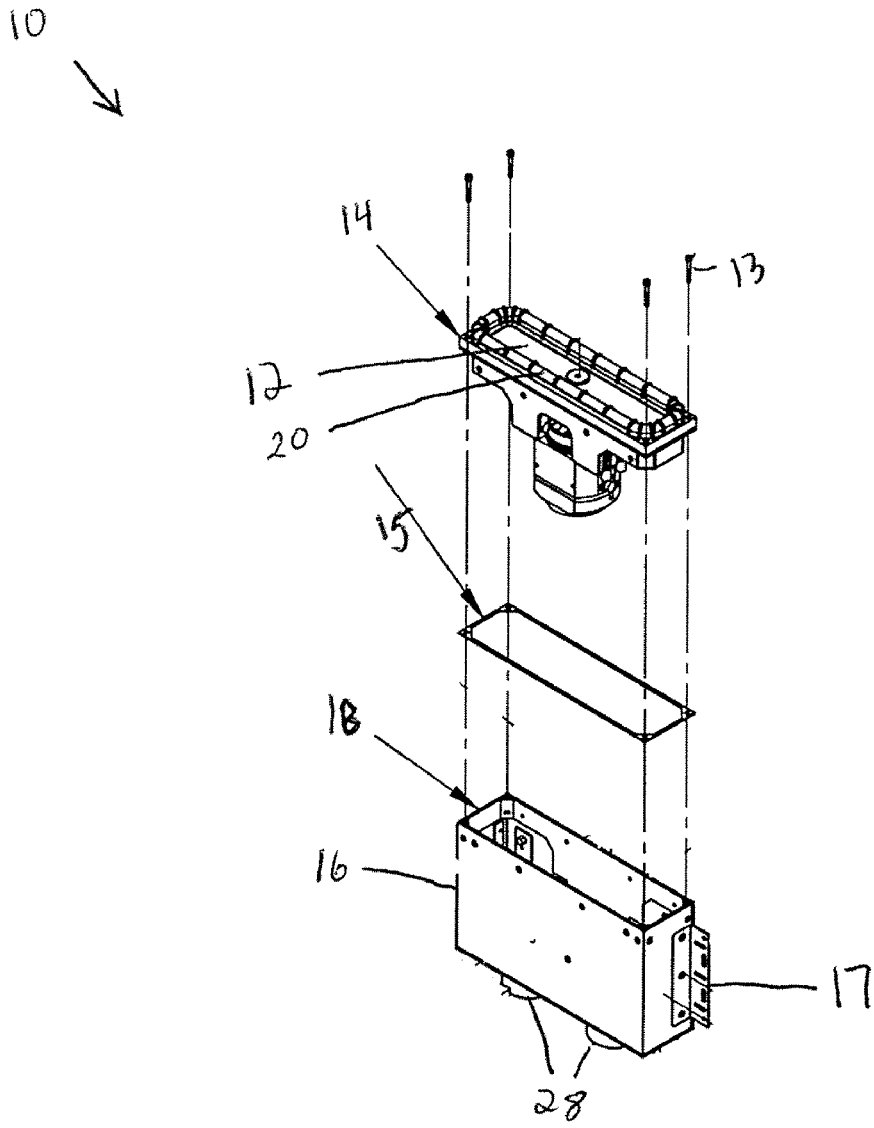
Figure 1E:
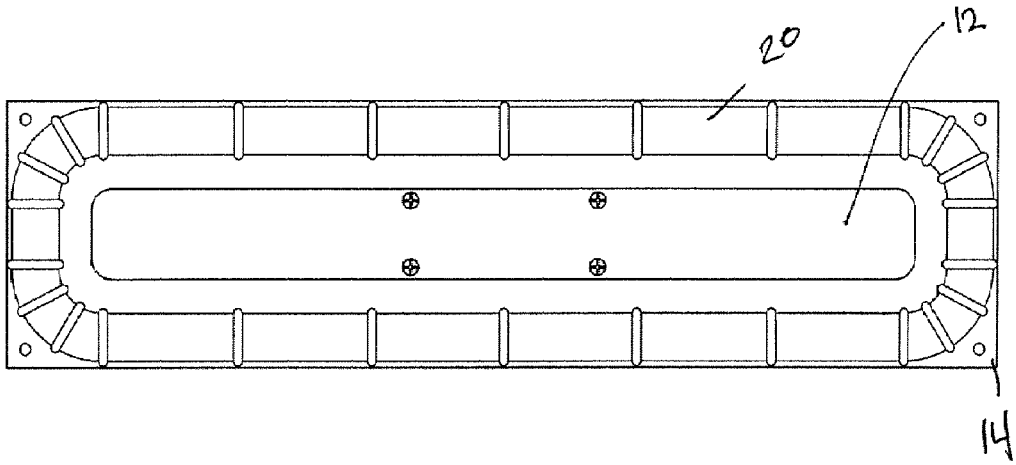
Figure 2:
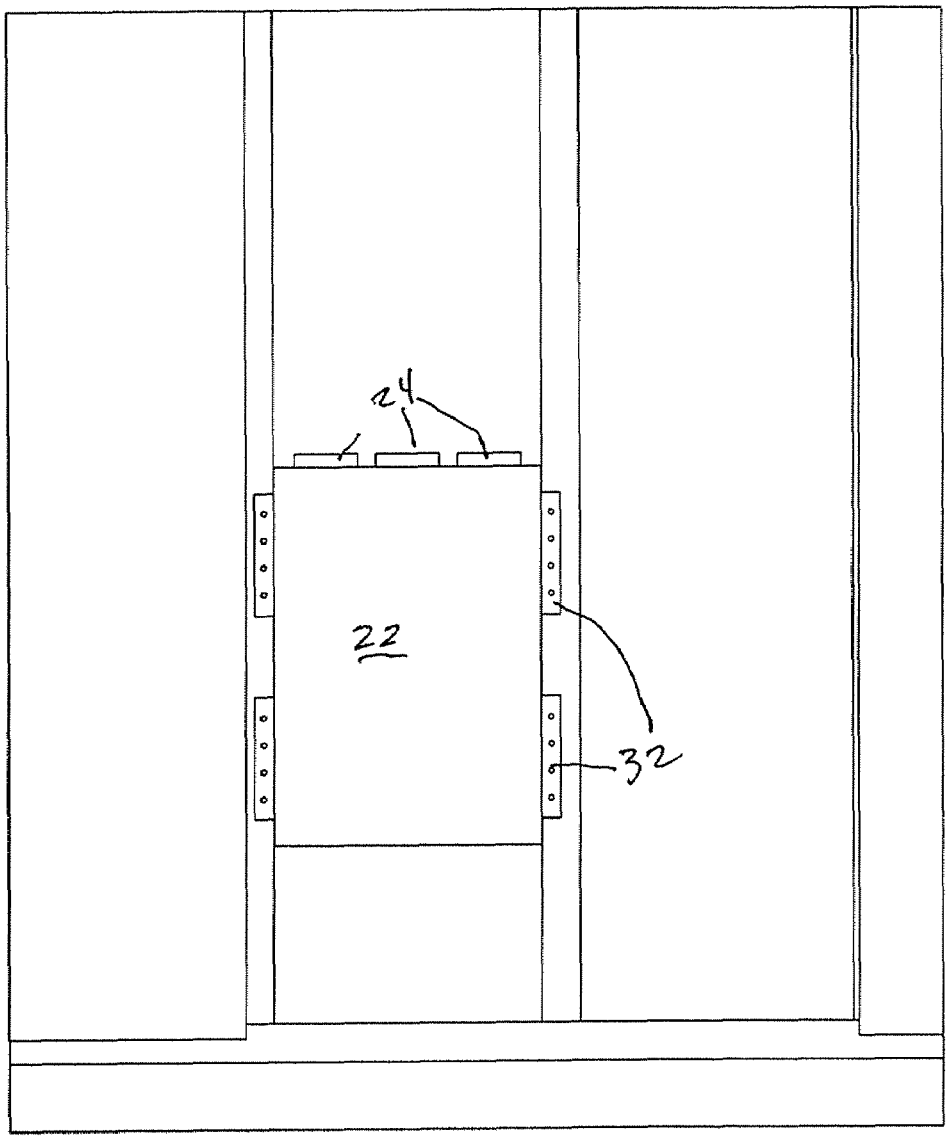
FIG. 2 is an perspective view of a second housing of the speaker system mounted in a wall.
Figure 3:
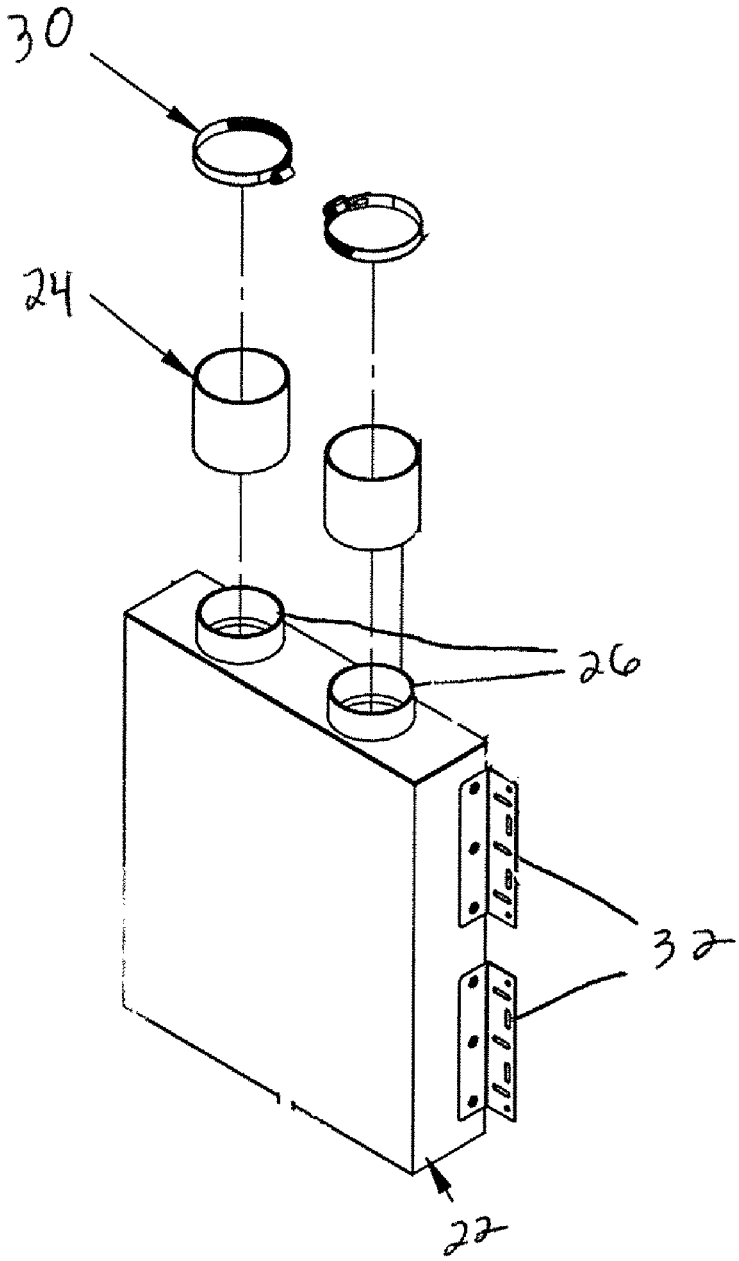
FIG. 3 is an isometric view of the second housing of the speaker system.

As shown in FIG. 1A, a speaker system 10 is mounted within a wall 23 between studs 25*a*, 25*b*. The speaker system includes housings 16, 22 that may be directly secured to the studs 25*a*, 25*b* by means of mounting brackets 17, 32 or the like. In typical construction, the studs 25*a*, 25*b* have a depth of 3½ inches and are spaced 16 inches apart. The housings 16, 22 are therefore sized to fit within a column of space having this cross sectional area. In some instances studs 25*a*, 25*b* having a depth of 4 or 6 inches are used. In such embodiments, the housings 16, 22 may be made large enough to substantially occupy the entire cross sectional area. The housings 16, 22 are covered by drywall 23 on either side of the housings 16, 22. In practice, the second housing 22 is installed before the drywall 23. A vent opening is formed in the drywall 23 to install the driver housing 16. In this way, the more expensive driver housing 16 and contained components are not installed until the structure is complete enough to be secure from theft, and the smaller vent opening in the drywall 23 is needed to install the smaller driver housing 16.

Referring to FIGS. 1B-E, 2 and 3, the speaker system 10 includes a cone or radiating member 12 serving to cause acoustical waves in the surrounding air. A driver 14 secures to the cone 12 and causes the cone 12 to vibrate according to a signal supplied to the driver 14. The cone 12 has an elongate shape, such that in a horizontal plane the width of the radiating member is larger than its depth. The cone 12 and driver 14 are vertically aligned having the driver 14 either above or below the cone 12.

The cone 12 and driver 14 mount within a driver cabinet (or driver housing or first housing) 16 having an elongate shape, such as a narrow rectangle, in the horizontal plane. The cone 12 is positioned within an opening 18 at the top of the housing 16. A gasket 15 which may be made of foam is attached between the driver 14 and the housing 16. A surround (or sealing member or resilient seal) 20 surrounds the cone 12 and mounts the cone 12 to the housing 16. The surround 20 is formed of a flexible resilient material, such as rubber, such that the cone 12 has a vertical range of motion relative to the housing 16. The surround 20 prevents substantial passage of air past the cone 12. The housing 16 is attached to adjacent studs 25*a*, 25*b* (FIG. 3) with brackets 17 located on opposite sides of the housing 16.

A second cabinet or housing 22 secures within the wall near the driver housing 16. The second housing 22 is preferably positioned near the end of the driver housing 16 opposite the cone 12. The second housing 22 provides a reservoir of air that resonates according to vibration of the cone 12. The second housing 22 insulates the wall or drywall 23 from the vibration of the speaker system 10, as well as isolating the back wave of the driver 14 from the front wave.

The second housing 22 is fluidly connected to the driver housing 16 by one or more tubes 24 that attach to second housing apertures 26 and driver housing apertures 28 with clamps 30 or other attachment means. The second housing 22 is attached to adjacent studs 25*a*, 25*b* with brackets 32 located on opposite sides of the second housing 22.

Figure 4A:
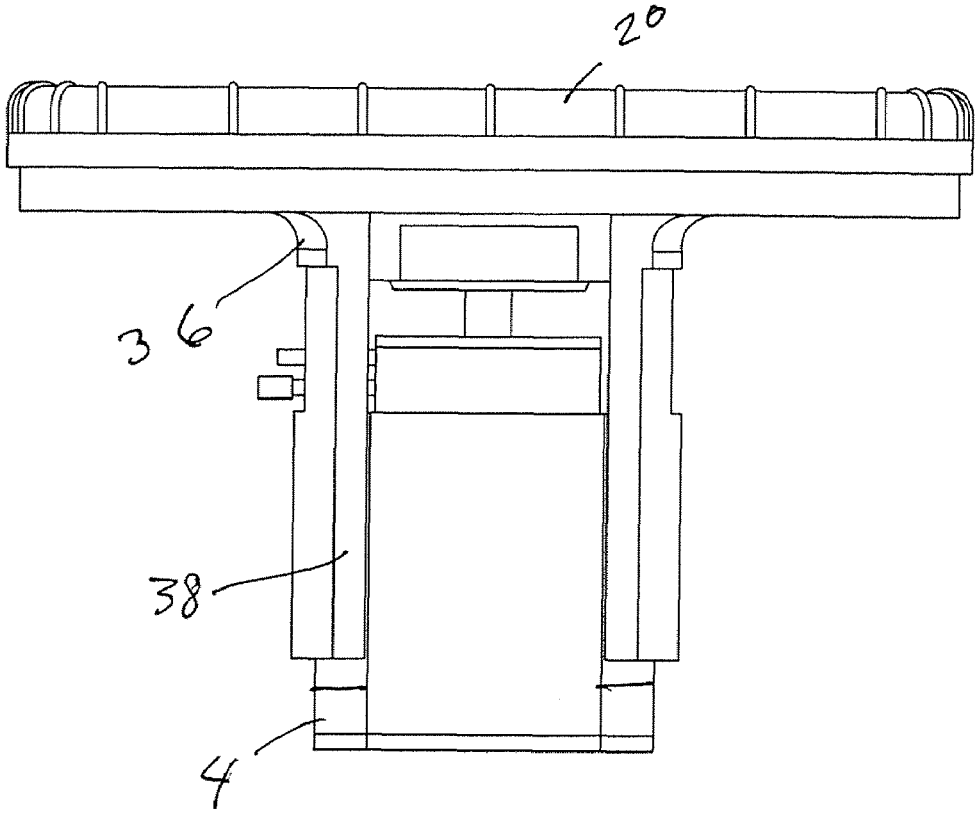
FIG. 4A is an isometric view.
Figure 4B:
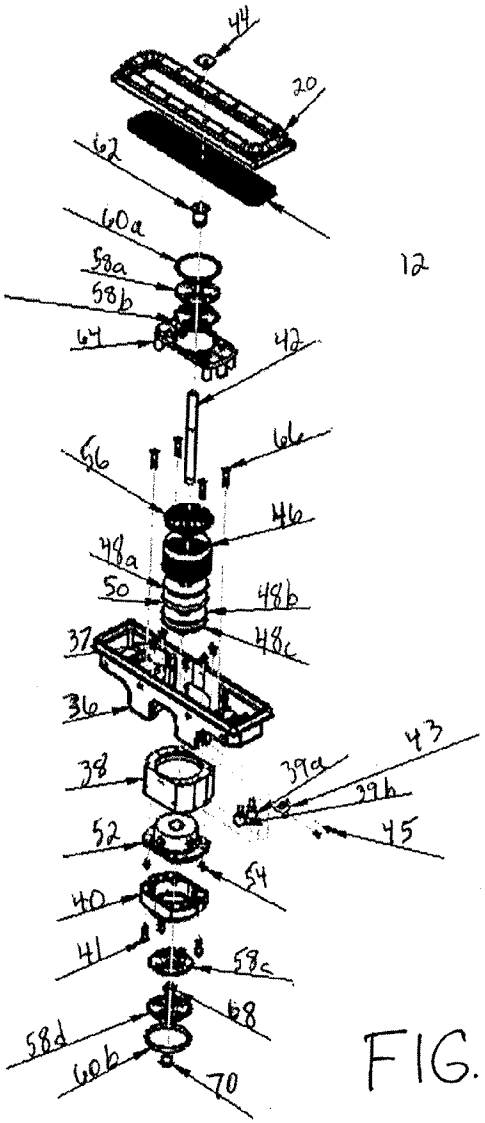
FIG. 4B is an isometric exploded view of a driver assembly according to the present invention.
Figure 4C:
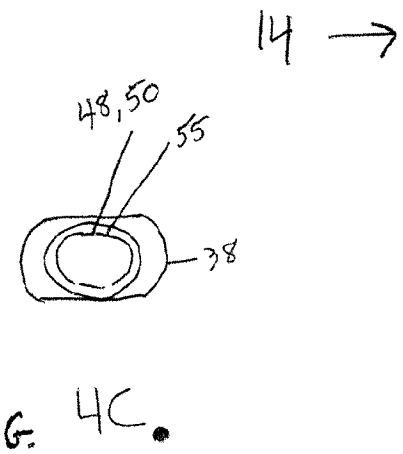
FIG. 4C is a top partial view of the driver assembly showing a magnetic gap.

FIGS. 4A, 4B and 4C show an isometric view, an exploded isometric view, and a top partial view, respectively of the driver 14 along with the cone 12 and the surround 20. FIG. 4A shows the surround 20 attached to the cone 12 and a plastic basket 36. The basket 36 is attached to the surround 20 via an adhesive, and is further attached to a steel motor housing 38 and a polycarbonate composite rear spider housing 40 with a plurality of screws 41. The cone 12 is connected to a shaft 42 with a shaft cap 44. A pair of connectors 39*a*, 39*b* is attached to flexible wire leads (not shown) which provide an electrical connection to the voice coil assembly 46. A thermal regulator 43 is attached with a pair of screws 45 to the motor housing 38 and acts to break the electrical connection between a voice coil assembly 46 and the connectors 39*a*, 39*b* when the temperature exceeds a predetermined level.

The motor housing 38 contains the voice coil assembly 46, three magnets 48*a*, 48*b*, 48*c*, which may be made of neodymium or other suitable material, and a steel top plate 50, all supported by a steel T-yoke 52 attached to the bottom of the motor housing 38 with a plurality of screws 54. A magnetic gap 55 is located between the outer edges of the top plate 50 and magnets 48*a*, 48*b*, 48*c* and the inner surface of the motor housing 38. Above and coupled to the voice coil assembly 46 is a coil adapter 56 which facilitates transfer of energy from the voice coil assembly 46 to the shaft 42.

Two pair of spiders or resilient suspension members 58*a*, 58*b* and 58*c*, 58*d* located along the length of and attached to the shaft 42 near the top and bottom of the shaft 42 via first and second adapters 62, 68 keep the shaft 42 and voice coil assembly 46 centered in the magnetic gap 55. The outer diameters of the spiders 58*a*, 58*b* and 58*c*, 58*d* are connected to the basket 36 and the motor assembly 38, respectively, via a spider landing 64 and the rear spider housing 40. A pair of spider clamps 60*a*, 60*b* connect respective pairs of spiders 58*a*, 58*b* and 58*c*, 58*d* together. The first adapter 62 prevents contact between the spider 58*a* and the cone 12. The spider landing 64 prevents contact between the spider 58*b* and the coil adapter 56, and is attached to the basket 36 with a plurality of screws 66. The second pair of spiders 58*c*, 58*d* are located in the rear spider housing 40. A bottom shaft cap 70 is attached to the bottom of the shaft 42 and affixes the second adapter 68 to the shaft 42.

FIG. 5 is an exploded isometric view of the cone 12. The cone 12, in one embodiment, includes three layers. The top and bottom layers 72, 76 are made of carbon fiber, aluminum, Kevlar™, or other suitable lightweight materials, and the middle layer is made of white rohescell, or any other lightweight rigid filler material. Each layer 72, 74, 76 includes a shaft aperture 78, 80, 82 to receive the shaft 42 and shaft cap 44.

Figure 6B:
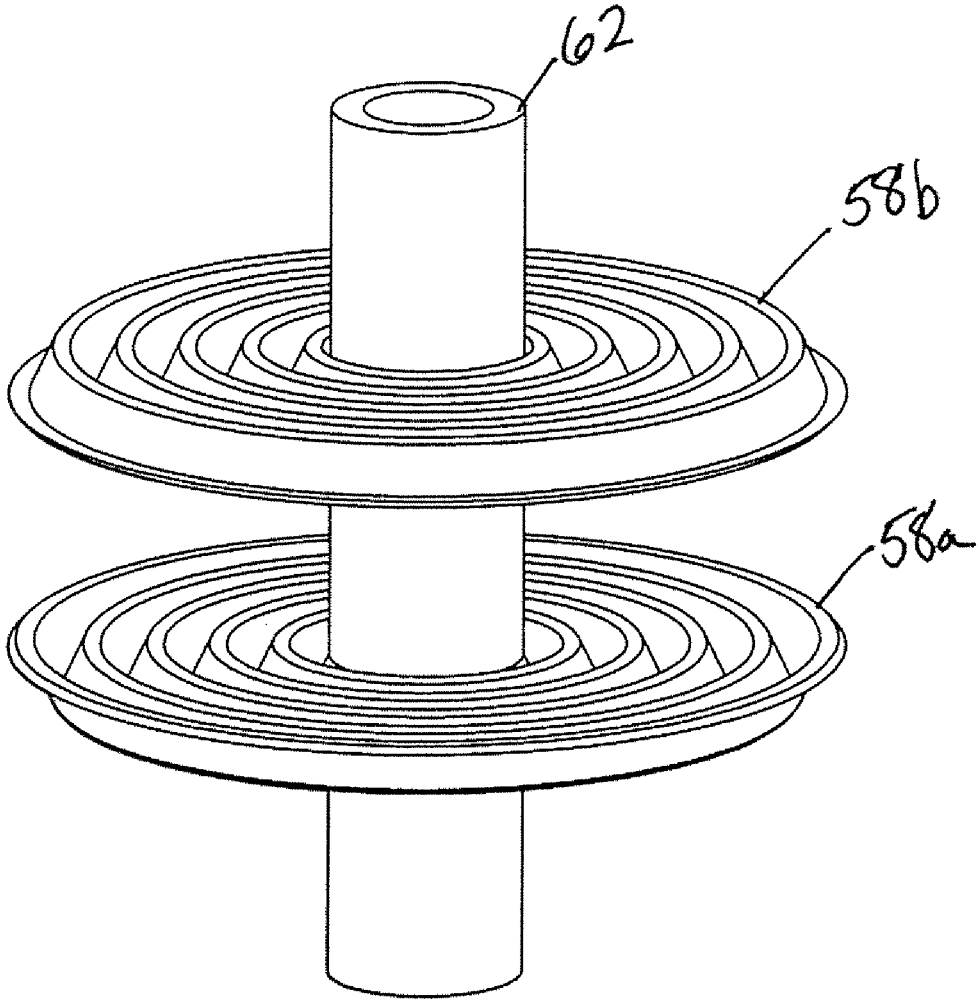
FIG. 6B is an isometric view of the shaft with attached spiders of the speaker assembly of FIG. 3.

FIG. 6A shows an isometric view of the shaft 42, and FIG. 6B shows an isometric view of the first adapter 62 with attached spiders 58*a*, 58*b* (and representative of the second adapter 68 with attached spiders 58*c*, 58*d*) shown spaced apart for clarity. The shaft 42 is preferably made of aluminum or other nonmagnetic rigid material and defines a larger diameter section 84 with two smaller diameter sections 86*a*, 86*b*. Section 86*a* is attached to the pair of spiders 58*c*, 58*d*, and section 86*b* is attached to the cone 12, the pair of spiders 58*a*, 58*b*, and the voice coil adapter 56. The spiders 58 are sized to fit the smaller diameter sections 86*a*, 86*b* via adapters 62, 68 and are positioned adjacent the larger diameter section 84 as shown in FIG. 6B with the motor housing 38 and voice coil assembly 46 located between the spiders on the larger diameter section 84.

Figure 7:
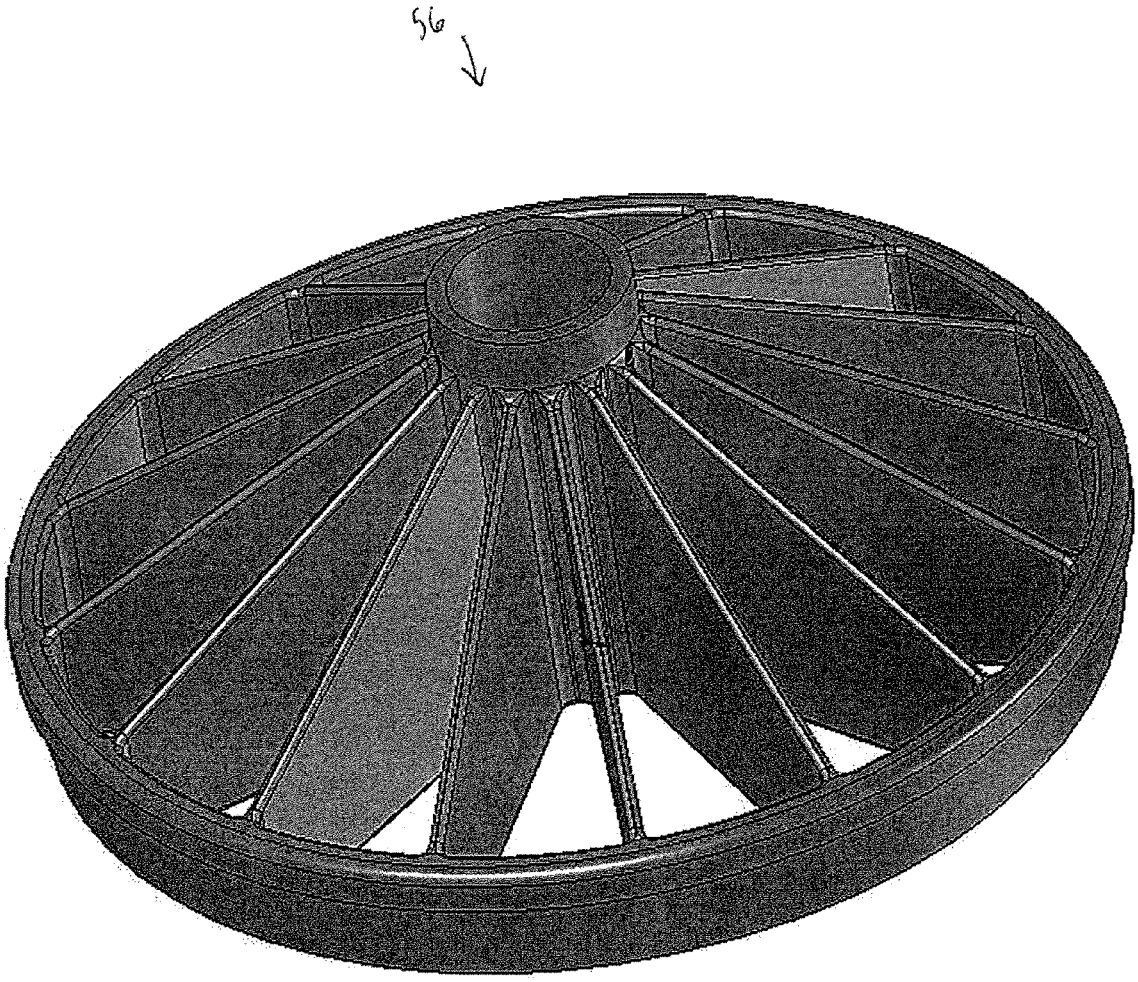
FIG. 7 is an isometric view of a coil adapter of the speaker assembly of FIG. 3.

FIG. 7 is an isometric view of the coil adapter 56. The adapter 56 is preferably made of a polycarbonate composite or other lightweight, nonmagnetic material. The adapter 56 is rigid and lightweight and connects the voice coil assembly 46 to the shaft 42 to provide a snug fit between the larger diameter voice coil assembly 46 and the smaller diameter shaft 42. The adapter 56 is cone-shaped to increase rigidity and vented to minimize drag.

Figure 8B:
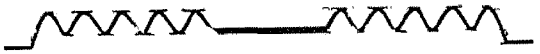
FIG. 8A is a top view and FIG. 8B is a side cross-sectional view of one of the spiders of the speaker assembly of FIG. 3.
Figure 8A:
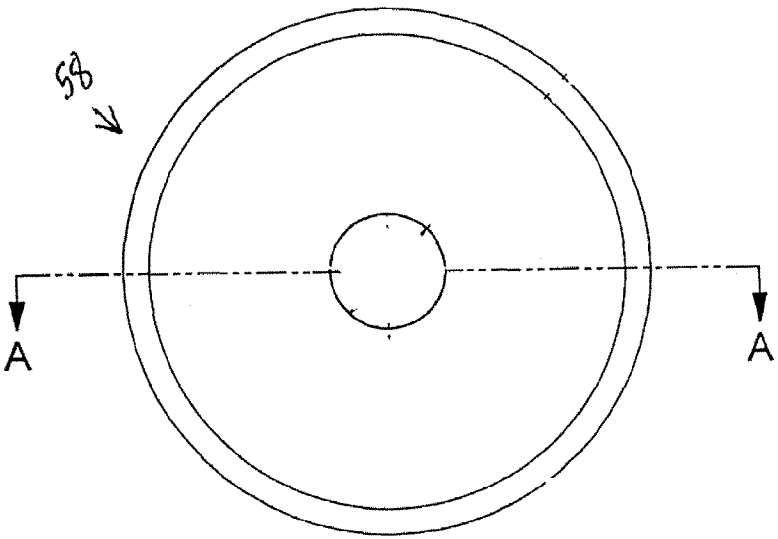

FIG. 8A is a top view and FIG. 8B is a side cross-sectional view of a spider 58. The spider 58 is made of an aramid fiber, preferably Nomex™, but can also be made of cotton or other fiber having the desired properties.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The invention claimed is:

1. A speaker system comprising:

a radiating member having an elongate shape in a plane perpendicular to a vertical axis;

an oscillating driver for actuating the radiating member;

a shaft having a longitudinal axis oriented substantially parallel to the vertical axis, the shaft coupling the radiating member to the driver;

at least a first resilient suspension member coupled to the shaft;

a first housing defining a first opening, the driver, the shaft, and the resilient suspension member positioned within the first housing and the radiating member mounted near the first opening by a resilient seal circumscribing the radiating member to substantially seal the upper opening, the resilient suspension member having a portion thereof fixed relative to the housing; and a second housing defining a volume at least as large as that of the first housing and at least a first opening, the first housing further comprising at least a second opening, the second housing positioned adjacent the first housing proximate the at least second opening, the at least first opening of the second housing being in fluid communication with the at least second opening of the first housing, wherein the first and second housings are sized and positioned relative to one another to occupy a columnar space having an elongate cross section and wherein the columnar space corresponds to a volume defined between two studs and opposing sheets of drywall in standard wall construction.

2. The speaker system of claim 1, wherein the first housing has a rectangular cross section sized to receive the radiating member.

3. The speaker system of claim 1, wherein the driver comprises a voice coil secured to the shaft and a magnet imposing a magnetic field on the voice coil.

4. The speaker system of claim 1, wherein the suspension member is a first suspension member, the speaker system further comprising a second resilient suspension member secured to the shaft distanced from the first suspension member.

5. The speaker system of claim 1, wherein the radiating member and seal permit a range of vertical movement of the radiating member and wherein the shaft is at least as long as the range of vertical movement.

6. The speaker system of claim 1, wherein the seal comprises a plurality of stiffening ribs extending radially between the radiating member and the first housing.

7. A speaker system positioned within a volume defined between two studs and opposing sheets of drywall forming a wall, the speaker system comprising:

a radiating member having an elongate shape in a plane perpendicular to a vertical axis;

an oscillating driver coupled to the radiating member;

a first housing sized to abut the studs and drywall and defining a first opening, the driver positioned within the first housing and the radiating member mounted near the first opening by a resilient seal circumscribing the radiating member to substantially seal the first opening; and a vent secured within one of the opposing sheets of drywall proximate the first opening of the first housing.

8. The speaker system of claim 7, further comprising a shaft having a longitudinal axis oriented substantially parallel to the vertical axis, the shaft coupling the radiating member to the driver; and a resilient suspension member coupled to the shaft, a portion of the resilient suspension member fixed relative to the first housing.

9. The speaker system of claim 7, further comprising a second housing abutting the studs and drywall and defining a volume at least as large as that of the first housing, the first housing further comprising at least a second opening, the second housing positioned adjacent the first housing proximate the second opening, the second housing having at least a first opening in fluid communication with the second opening of the first housing.

10. The speaker system of claim 7, wherein the driver comprises a voice coil secured to the shaft and a magnet imposing a magnetic field on the voice coil.

11. The speaker system of claim 7, wherein the suspension member is a first suspension member, the speaker system further comprising a second resilient suspension member secured to the shaft distanced from the first suspension member.

12. The speaker system of claim 7, wherein the radiating member and seal permit a range of vertical movement of the radiating member and wherein the shaft is at least as long as the range of vertical movement.

13. The speaker system of claim 7, wherein the seal comprises a plurality of stiffening ribs extending radially between the radiating member and the first housing.

14. A method for installing a speaker system within a volume defined between two vertically extending studs, the method comprising:

securing a loudspeaker within a first housing defining a first volume and having an opening extending vertically through one end thereof, the loudspeaker comprising a radiating member having an elongate shape in a plane perpendicular to a vertical axis, an oscillating driver for actuating the radiating member coupled to the radiating member, the oscillating driver and radiating member being vertically aligned within the first housing having the radiating member positioned proximate the opening;

securing the first housing between the studs having a longest dimension of the radiating member extending substantially perpendicular to the studs;

securing drywall across the studs; and forming a vent extending through the drywall proximate the opening.

15. The method of claim 14, wherein a shaft having a longitudinal axis oriented substantially parallel to the vertical axis couples the radiating member to the driver.

16. The method of claim 14, further comprising a resilient suspension member coupled to the shaft and having a portion thereof fixed relative to the housing.

17. The method of claim 14, wherein the opening of first housing is a first opening, the opening further defining a second opening vertically opposite the first opening, the method further comprising securing a second housing to the studs, the second housing defining a second volume at least as large as the first volume in fluid communication with the second opening.

18. A speaker system positioned within a wall defined by at least one structural member between opposing wall surfaces, the speaker system comprising:

a radiating member having an elongate shape in a plane substantially perpendicular to a plane defined by the wall;

an oscillating driver coupled to the radiating member;

a housing positioned between the opposing wall surfaces and defining an opening, the driver positioned within the housing and the radiating member mounted near the opening by a resilient seal circumscribing the radiating member to substantially seal the opening; and a vent formed within at least one of the opposing wall surfaces proximate the opening of the housing.

* * * * *